US007024709B2

(12) United States Patent
Moceri

(10) Patent No.: US 7,024,709 B2
(45) Date of Patent: Apr. 11, 2006

(54) REPLACEABLE HEADBOARD AND FOOTBOARD COVER

(76) Inventor: Sharon Moceri, 18472 Masonic Blvd., Fraser, MI (US) 48026

( * ) Notice: Subject to any disclaimer, the term of this patent is extended or adjusted under 35 U.S.C. 154(b) by 0 days.

(21) Appl. No.: 10/779,578

(22) Filed: Feb. 16, 2004

(65) Prior Publication Data

US 2005/0177940 A1 Aug. 18, 2005

(51) Int. Cl.
*A47C 31/00* (2006.01)

(52) U.S. Cl. ..... 5/482; 5/424; 5/663

(58) Field of Classification Search ..... 5/482, 5/424, 499, 663, 53.1, 280

See application file for complete search history.

(56) References Cited

U.S. PATENT DOCUMENTS

| | | | | |
|---|---|---|---|---|
| 2,641,779 | A * | 6/1953 | Gill | 5/53.1 |
| 4,646,376 | A | 3/1987 | Sulley | |
| 4,821,349 | A | 4/1989 | Cohen | |
| 5,099,988 | A | 3/1992 | Garran | |
| 5,802,637 | A * | 9/1998 | Bordo | 5/493 |
| 5,911,654 | A * | 6/1999 | Webb | 5/424 |

* cited by examiner

*Primary Examiner*—Heather Shackelford
*Assistant Examiner*—Fredrick Conley

(57) ABSTRACT

The replaceable headboard or footboard cover of the invention comprises frontal and rearward exterior segments mended together to form a sleeve. The decorative frontal exterior extends along the front of the headboard or footboard and provides the appearance of an open curtain swag thus integrating the existing headboard or footboard into the room decor as modified by the headboard cover. The rearward exterior extends along the back of the headboard or footboard and forms a cap to secure the cover to the headboard or footboard without extraneous fasteners. A system for decorating a bed comprising a headboard and footboard cover is also disclosed.

14 Claims, 4 Drawing Sheets

REPLACEABLE HEADBOARD AND FOOTBOARD COVER

FIELD OF THE INVENTION

The present invention relates to decorative upholstery. In particular, this invention relates to replaceable headboard and footboard covers.

BACKGROUND OF THE INVENTION

Redecorating can be used to transform a dull room into a reflection of personal or contemporary style. Time, budget and functionality are considerations. This is especially true when the room is a bedroom. Bedrooms are considered the place of relaxation and it is, therefore, desirable to redecorate with minimal stress.

Customized home decorating is expensive and requires an interior decorator and purchasing designer furniture, art and other accessories. This may be appropriate for someone desiring a complete design overhaul but is too costly and impractical for someone desiring a simple change. Home design books, magazines and television shows provide insight and fresh ideas to those working with a small budget, but some of the options are too bold and require numerous changes. Furthermore, these do-it-yourself projects teach destruction of the furniture because to achieve the desired effect, the owner must saw, hammer, staple, strip or use harsh adhesives to modify the furniture.

One redecorating option is to refinish one's current headboard and footboard. This option is not desirable because the time-intensive labor required to properly re-finish the bed must be repeated whenever the homeowner wants to update the decor. As used herein, a "bed" is a headboard and footboard and can optionally include side rails. Furthermore, the bed may be an antique or family heirloom and the classic significance would be decreased by stripping, painting or stenciling the bed.

Another option is to purchase a new headboard and footboard. While the owner may get the most up to date look, he or she has also spent from hundreds to thousands of dollars. If the owner prefers coordinating furniture, then they must invest additional money for a bedroom set. Purchasing a new bed may be unnecessary when the current bed is of superior craftsmanship.

To overcome these obstacles, the prior art provided a variety of headboard and footboard assemblies and decoration choices. These alternatives are limited in that some require purchasing a new headboard and footboard that are merely collapsible and flimsy metal or cardboard frames sparsely covered with fabric (U.S. Pat. Nos. 4,821,349; 4,646,376; and 5,099,988). Other options include a headboard cover attached to the headboard with a host of snaps and ties (U.S. Pat. No. 2,641,779).

It would be desirable to provide a means to maintain current home decorating trends without significant financial or time investment. It would also be desirable to change the appearance of a bed while preserving the existing headboard and footboard. It would be further desirable to provide a high level of consumer control and allows the consumer to easily and economically maintain current home decorating trends.

SUMMARY OF THE INVENTION

The present invention relates to headboard and footboard covers, each comprising a sleeve having a frontal exterior and a rearward exterior. The frontal exterior extends towards a bed along the front portion of a headboard or footboard and further comprises a first panel and a second panel. The first and second panels are scalloped to form a swag. The rearward exterior extends towards the bed along the rear portion of the headboard or footboard and is a sufficient length to cap the headboard or footboard. The frontal exterior and rearward exterior are connected by at least one seam.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment(s) is merely exemplary in nature and is in no way intended to limit the invention, its application, or uses.

Embodiments of this invention relate to replaceable covers for headboards and footboards. The headboard and footboard covers can be used independently or simultaneously thus creating a bed decorating system. Embodiments of this invention can be used for twin, full, queen, king, California king or custom sized headboards and footboards. The detailed description of the replaceable cover is applicable to a headboard or footboard according to embodiments of this invention. While the dimensions of the headboard and footboard may vary according to the design of the bed, it is understood the assembly method for a headboard cover is the same as for the footboard cover. Emphasis of either the headboard cover or the footboard cover is merely exemplary.

Figure 1:
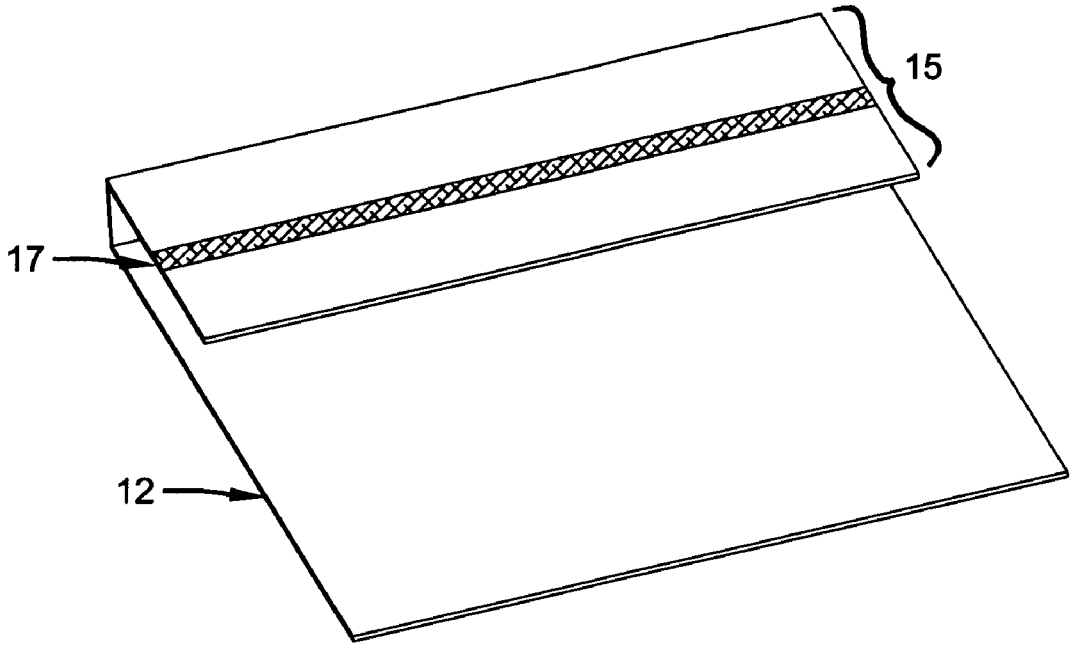
FIG. 1 is an assembly view of a headboard cover.

The general assembly of the headboard cover shown in FIG. 1 comprises three parts: 1) frontal exterior 12; 2) a rearward exterior 15; and 3) a constriction element 17. The frontal exterior 12 and rearward exterior 15 of the cover are made of any type of material that can be sewn or otherwise mended together, such as fabric. The fabrics can include, but are not limited to, upholstery, twill, broadcloth, woolens, satin, linen, fleece, Lycra®, flannel, velvet, denim, corduroy, silk, chiffon, taffeta or polyester. It is not beyond the scope of embodiments of this invention that the materials used also include leather, fur, vinyl or plastic.

The fabric or material can be from the bolt in flat or panel form or it can be pleated, pin tucked, gathered or otherwise manipulated, thus providing additional ornamental effect.

The constriction element 17 can be a stretchable material such as elastic inserted into the rearward exterior 15. The constriction element 17 can be a material with the inherent property of being able to return to the original form from which it was depressed or overtaxed such as elastic.

Examples include, but are not limited to, braided elastic, flat elastic, oval or round stretch cords, stretch lace or heavy stretch elastic. The length of the elastic will vary based on the strength or elasticity.

The number of seams required will depend on where the fabric is folded. In an embodiment where the cover is formed from one piece of fabric or material, the cover can be sewn or mended along the sides for support. In an embodiment where a plurality of materials is used, the cover is sewn or mended together along the top and sides for support. Additional seams may be added for finishing purposes.

Figure 2:
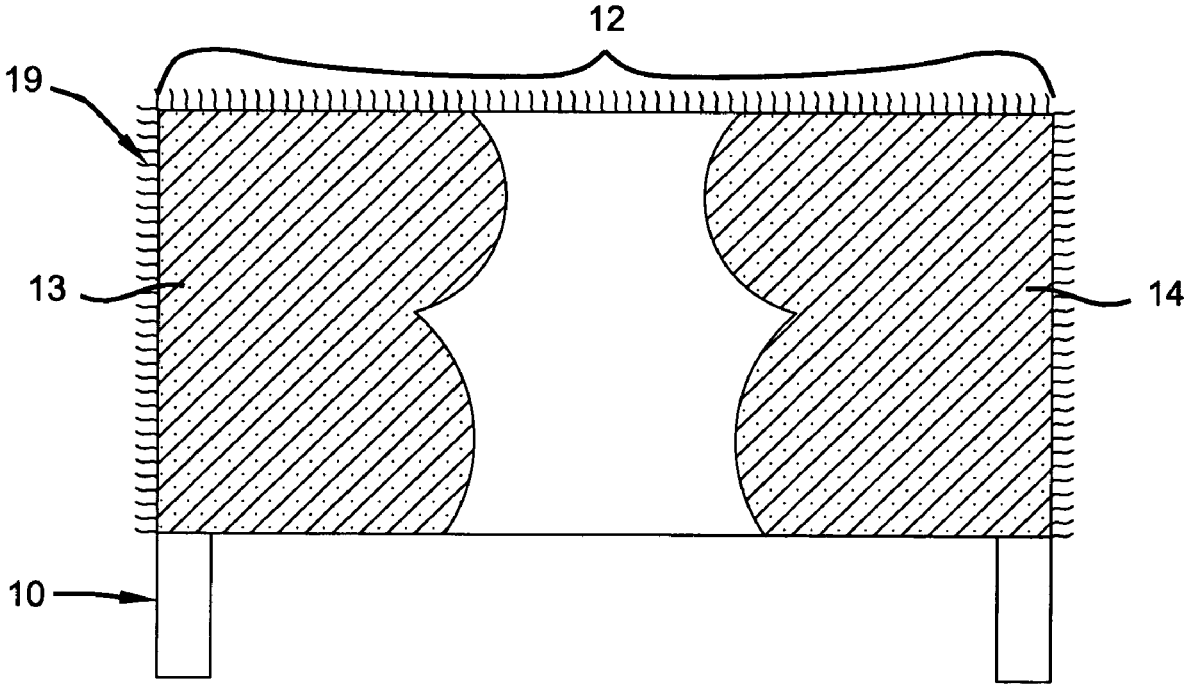
FIG. 2 depicts the frontal exterior of a headboard cover.
Figure 6:
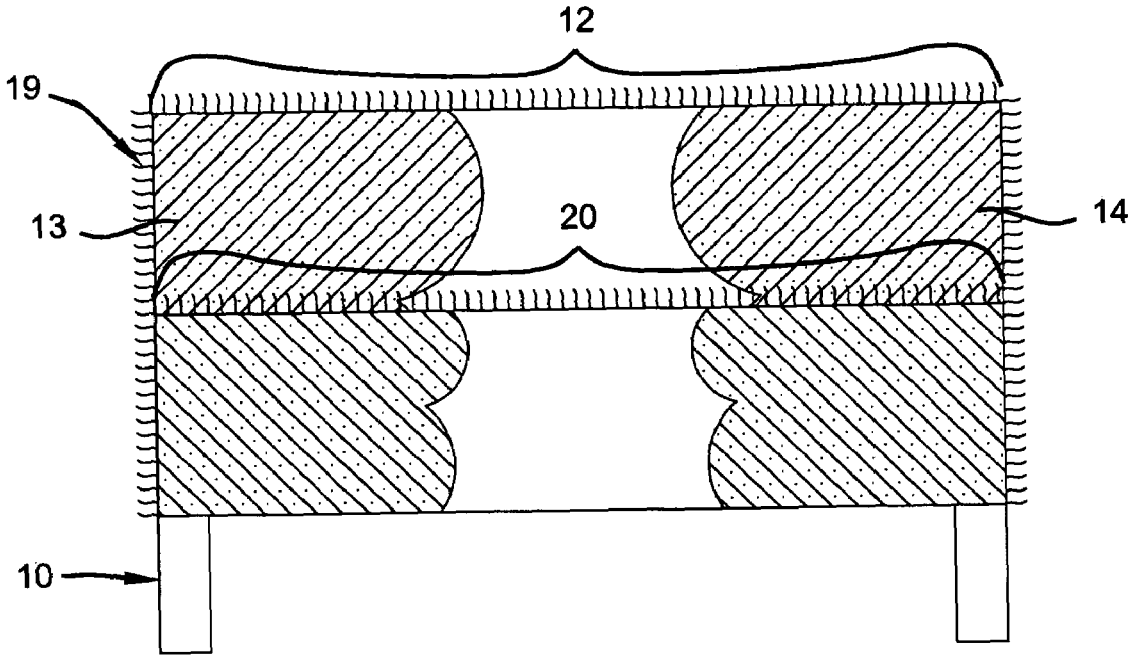
FIG. 6 is a frontal view of a headboard and footboard cover.

FIG. 2 shows the design of the frontal exterior of an embodiment of this invention. The frontal exterior 12 can be further divided into a first panel 13 and a second panel 14. Each panel 13, 14 is scalloped in order to provide the appearance of an open curtain swag. FIG. 6 depicts the panels of a footboard cover 22 with the open curtain swag comprising a first panel 23 and a second panel 24. This swag allows for the underlying headboard or footboard to remain partially exposed and become incorporated into the new decor. Even with the new cover or system of headboard and footboard covers in place, the bed still coordinates with other furniture in the room and only enhances and does not detract from the look of a "bedroom set". The cover provides an open swag without requiring that a fastener or hook be screwed into the existing headboard or footboard. This feature preserves the bed by preventing gluing, drilling or nailing hooks or tie-backs into the headboard and footboard.

In an embodiment where one continuous piece of fabric or material is used, the scallop is created by cutting out a piece of the fabric or material from the section designated as the frontal exterior 12. In an alternative embodiment, the swag is created to resemble an inverted "U". As depicted, the swag style is similar for the headboard cover 12 and the footboard cover 22. FIG. 6. The swag or amount of the underlying bed exposed can be different for the headboard and the footboard.

If separate pieces of fabric or material are sewn or mended together to form the cover, the first panel 13 or 23 and the second panel 14 or 24 must be sewn or mended to the rearward exterior at the sides and along the top of the cover. Using two separate pieces of fabric or material to create the frontal exterior provides endless design options. For example, if the desired decor was a southwestern theme, each panel could be a different fabric, texture or color such as using brown suede with a bright woolen. On a child's bed, one panel could be printed with the alphabet and the other could contain numbers. Additionally, the headboard and footboard covers can have matching materials or each panel (13, 14, 23 and 24 FIG. 6) of the headboard and/or footboard can be a different material.

The amount of headboard or footboard exposed can vary based on the size of the swag. This can be achieved by increasing or decreasing the amount of fabric used to form the panels. In an embodiment where the swag is formed as an inverted "U", the depth or width of the opening forming the swag is adjusted similarly.

Decorative trim 19, 29 can also be added to the cover. The trim can include, but is not limited to, piping, lace, eyelet or ruffled, gathered or braided fabric or ribbon.

Figure 3:
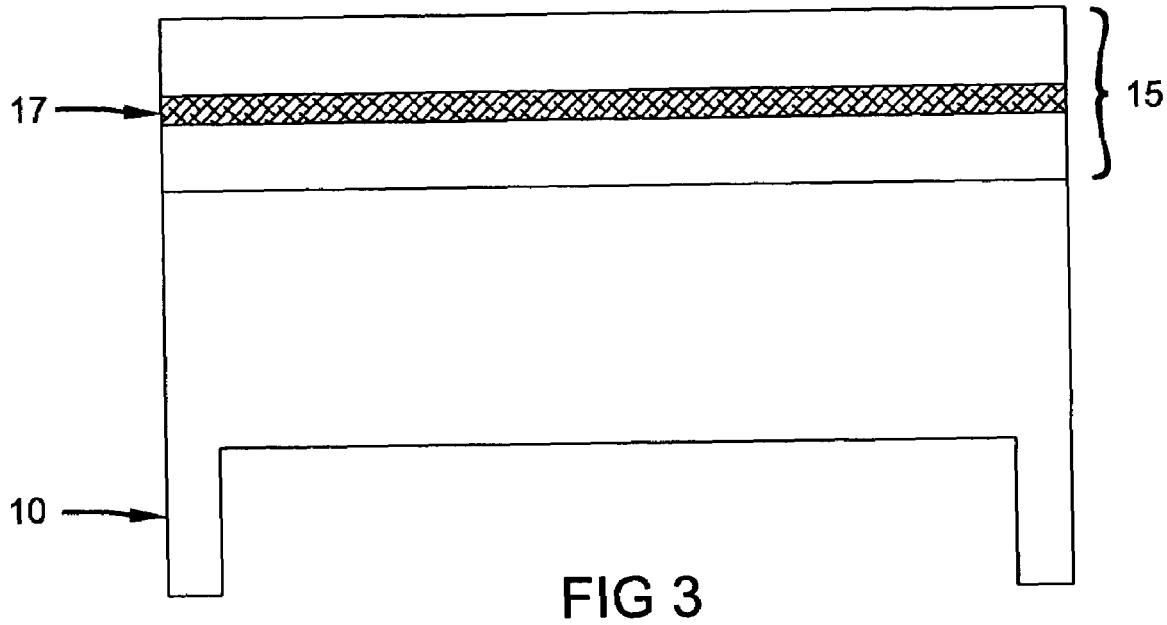
FIG. 3 depicts the rearward exterior of a headboard cover.

FIG. 3 is a rear view of the cover. The rearward exterior 15 of the cover fits over only a portion of the headboard and has a sufficient overhang over the headboard to make the cover self supporting and free from extraneous screws, bolts, ties or other fastening mechanisms. The overhang allows the cover to be self-supporting and prevents the cover from slipping off the bed while the owner is making or using the bed. A similar self-supporting overhang is used with the footboard 20 as depicted in FIG. 6. Thus, the headboard cover forms a cap over the headboard 10, FIG. 4. The frontal exterior 12 drapes the front of the headboard while the rearward exterior 15 covers only a portion of the headboard rear creating an overhang.

Preferably the overhang is from about 7 inches to about 12 inches in length. It is understood that variations in the thickness of the bed or variations in the material could require some deviation from the preferred overhang range to allow for cover self support and to provide an appropriate pocket size. For example, a thin headboard for a twin size bed will require less of an overhang for support than a California king size wooden sleigh bed.

Using the same amount of fabric on the front side and backside of the headboard or footboard can be expensive, especially because specialty fabrics available in retail fabric and craft stores can cost hundreds of dollars per yard. Having a self supporting cover that does not require covering the entire back of the headboard or footboard is economical because of the limited visibility of the back side of the headboard or footboard. For example, the back side of the headboard is generally not exposed or rests against a wall.

The cover is further supported by the constriction element 17. The constriction element 17 reinforces the overhang and keeps the cover tightly placed against the headboard. As stated herein, the constriction element can be a stretchable band such as elastic. In a preferred embodiment, the constriction element 17 is disposed in the rearward exterior of the cover. The constriction element is of sufficient length and width to make the fabric or material fit tightly against the headboard and prevent slipping or inadvertent removal of the cover. The top of the constriction element 17 begins around the vertical midpoint of the rearward exterior of the cover. For example, in a preferred embodiment with a rearward exterior length of 12 inches, the constriction element 17 would be inserted about 6 inches from the rearward exterior top. Placing the constriction element 17 near the rearward exterior vertical midpoint is only a guideline. A degree of flexibility is required with certain fabric or stretchable band combinations and headboard or footboard types.

Using a soft elastic band allows the cap to fit closely on the headboard and prevents cover slippage without damaging or marking the headboard. When the cover is changed or cleaned, the elastic facilitates non-abrasive removal and replacement of the cover. In other headboard cover assemblies, the cover must be unstapled or unscrewed from the headboard then a new or cleaned over is hammered, screwed or stapled into the headboard. This system makes the headboard unsightly by causing a series of nail or screw holes or staple marks. Even if great care is used to align the cover for fastening by using the same indentations, over time the holes will become "stripped" and useless and the user must bore additional holes into the headboard.

Figure 4:
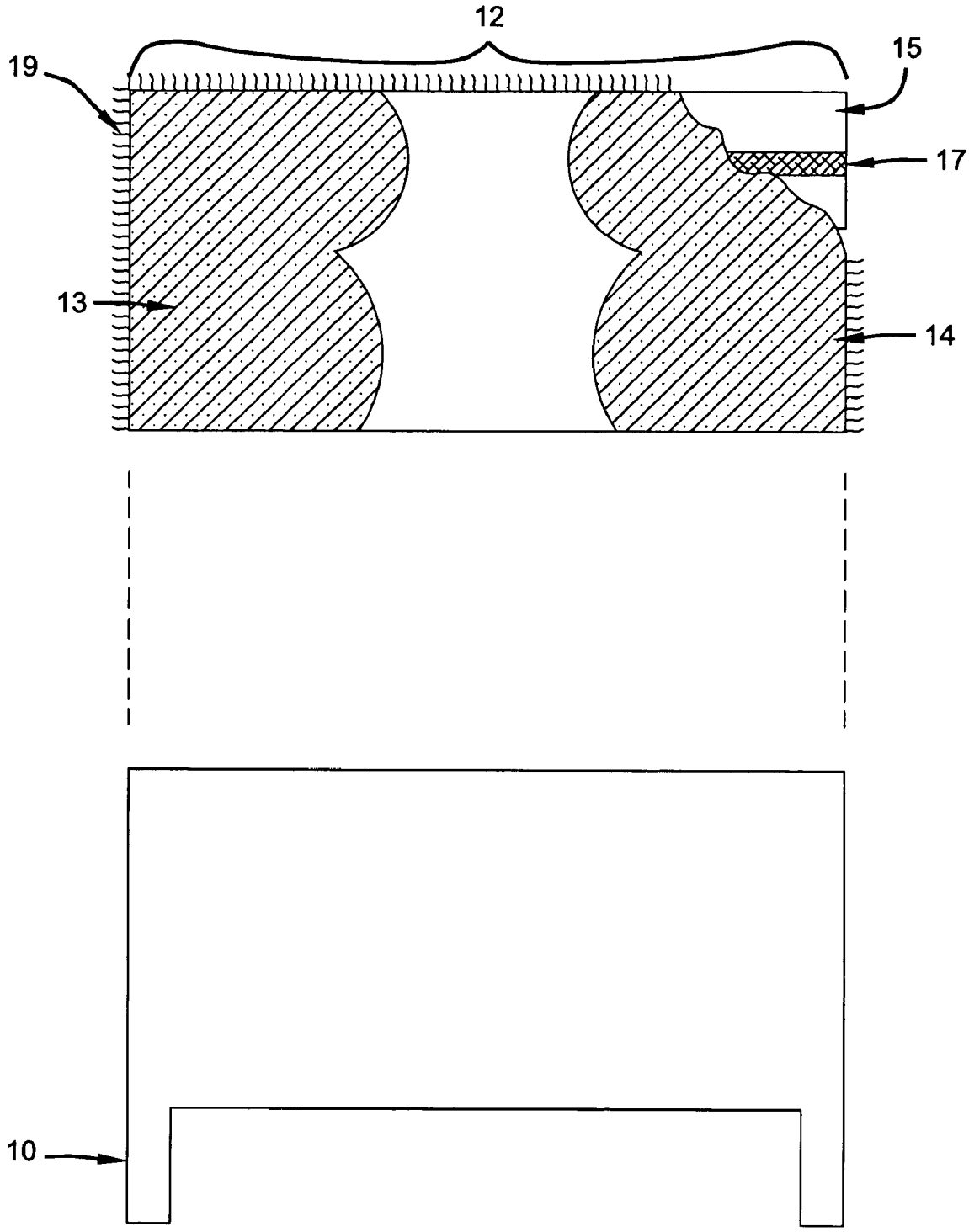
FIG. 4 is a frontal view of headboard cover orientation respective to a headboard.

One of the many advantages of embodiments of this invention is simple use. The cover slips right over the existing headboard and does not require any tools, snaps or ties, as shown in FIG. 4. Children and those with arthritis or other physical limitations can easily use the cover.

Figure 5:
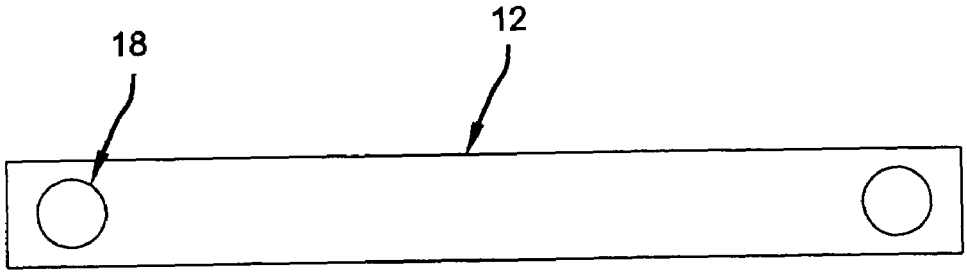
FIG. 5 is a top view of a headboard cover with post receptacles.

The cover may also be adapted to fit headboards and footboards with posts. In FIG. 5, the slits or openings 18 glide over the headboard posts. The slits or openings 18 contain elastic materials such as those described herein to allow the slits to mold to or become "scrunched" against the shape of the posts. The slits can also have decorative trim (such as those described herein) added to camouflage the openings and add a further decorative element.

The description of the invention is merely exemplary in nature and, thus, variations that do not depart from the gist of the invention are intended to be within the scope of the invention. Such variations are not to be regarded as a departure from the spirit and scope of the invention.

The invention claimed is:

1. A cover for a headboard or footboard comprising a sleeve having a frontal exterior, a rearward exterior, and a plurality of openings to receive headboard or footboard posts, wherein said frontal exterior extends toward a bed along the front portion of said headboard or footboard and further comprises a first panel and a second panel, wherein said first and second panels are scalloped to form an open curtain swag adapted to expose a portion of said headboard or footboard; and said rearward exterior extends toward said bed along the rear portion of said headboard or footboard and is a sufficient length to cap said headboard or footboard, wherein said frontal exterior and said rearward exterior are connected by at least one seam.

2. A cover according to claim 1, wherein said rearward exterior is from about 7 inches to about 12 inches in length.

3. A cover according to claim 1, further comprising a constriction element disposed in said rearward exterior at about one half of the length of said rearward exterior.

4. A cover according to claim 3, wherein said constriction element is located about 6 inches from the top of said rearward exterior.

5. A cover according to claim 3, wherein said constriction element is elastic.

6. A cover according to claim 5, wherein said elastic is selected from the group comprising braided elastic, flat elastic, oval or round stretch cords, stretch lace or heavy stretch elastic.

7. A cover according to claim 1, wherein said sleeve is comprised of fabric.

8. A cover according to claim 7, wherein said fabric is selected from the group comprising upholstery, twill, broadcloth, woolens, satin, linen, fleece, Lycra®, flannel, velvet, denim, corduroy, silk, chiffon, taffeta, polyester, leather, fur, vinyl or plastic.

9. A cover according to claim 1, wherein said cover is twin, full, queen, king or California king size.

10. A cover according to claim 1, further comprising a decorative trim.

11. A cover according to claim 10, wherein said decorative trim selected from the group comprising piping, lace or eyelet.

12. A cover according to claim 10, wherein said decorative trim comprises ruffled, pleated, gathered or braided fabric or ribbon.

13. A cover comprising a sleeve having a frontal exterior, a rearward exterior, and a plurality of openings to receive headboard posts, wherein said frontal exterior extends toward a bed along the front portion of said headboard or footboard and further comprises a first panel and a second panel, wherein said first and second panels are scalloped to form a swag; and said rearward exterior extends toward said bed along the rear portion of said headboard or footboard and is a sufficient length to cap said headboard or footboard, wherein said frontal exterior and said rearward exterior are connected by at least one seam.

14. A system for decorating a bed comprising:

a) a headboard cover comprising a sleeve having a frontal exterior and a rearward exterior wherein said frontal exterior extends towards a bed along the front portion of a headboard and further comprises a first panel and a second panel, wherein said first and second panels are scalloped to form an open curtain swag adapted to expose a portion of said headboard; and said rearward exterior extends towards said bed along the rearward exterior extends toward said bed along the rearward portion of said headboard and is a sufficient length to cap said headboard, wherein said frontal exterior and said rearward exterior are connected by at least one seam; and b) a footboard cover comprising a sleeve having a frontal exterior and a rearward exterior wherein said frontal exterior extends towards a bed along the front portion of a footboard and further comprises a first panel and a second panel, wherein said first and second panels are scalloped to form an open curtain swag adapted to expose a portion of said footboard; and said rearward exterior extends towards the bed along the rearward exterior extends toward said bed along the rearward portion of said footboard and is a sufficient length to cap said headboard, wherein said frontal exterior and said rearward exterior are connected by at least one seam, wherein at least one of said headboard cover or footboard cover includes a plurality of openings to receive headboard or footboard posts.

* * * * *